US009867757B2

(12) United States Patent
Rossiter

(10) Patent No.: US 9,867,757 B2
(45) Date of Patent: Jan. 16, 2018

(54) CONNECTIVE TISSUE MODIFICATION CUFF

(71) Applicant: Richard Rossiter, Laramie, WY (US)

(72) Inventor: Richard Rossiter, Laramie, WY (US)

(73) Assignee: Richard H. Rossiter, Laramie, WY (US)

( * ) Notice: Subject to any disclaimer, the term of this patent is extended or adjusted under 35 U.S.C. 154(b) by 702 days.

(21) Appl. No.: 14/271,456

(22) Filed: May 7, 2014

(65) Prior Publication Data

US 2015/0320629 A1 Nov. 12, 2015

(51) Int. Cl.
*A61H 1/00* (2006.01)
*A61H 7/00* (2006.01)

(52) U.S. Cl.
CPC ..... *A61H 7/001* (2013.01); *A61H 1/008* (2013.01); *A61H 2201/164* (2013.01); *A61H 2201/165* (2013.01); *A61H 2201/1635* (2013.01)

(58) Field of Classification Search
CPC ..... A61F 5/024; A61F 5/028; A61H 1/008; A61H 7/001
See application file for complete search history.

(56) References Cited

U.S. PATENT DOCUMENTS

D412,365 S * 7/1999 Szabo ..... D24/200
6,974,432 B2 * 12/2005 Reinecke ..... A61F 5/024 602/19
7,135,007 B2 * 11/2006 Scott ..... A61F 13/085 602/75
2003/0135134 A1 * 7/2003 Chase ..... A61F 5/028 600/595
2012/0323154 A1 * 12/2012 Ingimundarson ..... A61F 5/01 602/16

* cited by examiner

*Primary Examiner* — Matthew F Desanto

(57) ABSTRACT

A connective tissue modification cuff can be applied around a portion of the body and drawn tight. Integrated within the portion of the cuff that is pressed against the body is a plurality of variable compression beads. These variable compression beads comprise half spherical beads, half prolate spheroid beads, half oblate spheroid beads, or other similarly rounded structures that provide variably increasing pressure towards their high-points and gradually reduced pressure towards their low points. The cuff can be tightened down via a tensioning system that allows even tightening in small increments. Once in place, the person then stretches or uses the arm in order to apply the variable compression beads to the connective tissue under use. Such application works on the underlying connective tissue to reduce the pain and associated problems.

18 Claims, 4 Drawing Sheets

CONNECTIVE TISSUE MODIFICATION CUFF

TECHNICAL FIELD

The present invention relates generally to the field of pain alleviation products; and more particularly, to a connective tissue modification cuff adapted to help individuals alleviate pain in their bodies.

BACKGROUND

Athletes, sedentary people, and everyone in between can experience bodily pain at various times throughout their lives. As we age, these incidences of pain can increase in severity, duration, and number. The medical profession has an entire field of specialties devoted to helping people mitigate and cope with pain. Additionally, there are a number of devices, over-the-counter & prescription medications, methods of body manipulation, cold and hot therapies, wraps, and other approaches that can be employed by individuals in order to manage their pain. However, many, if not most approaches to pain management focus on the symptoms rather than correcting the cause of pain. In some instances, the pain is caused by connective tissue that is too tight and needs to be stretched. What is needed is a way to work on connective tissue so as to reduce the pain and problems it can otherwise cause.

SUMMARY

One embodiment of the present invention comprises a connective tissue modification cuff that is applied around a portion of a person's body and drawn tight. Integrated within the portion of the cuff that is pressed against the body is a plurality of variable compression beads. These variable compression beads comprise half spherical beads, half prolate spheroid beads, half oblate spheroid beads, or other similarly rounded structures that provide variably increasing pressure towards their high-points and gradually reduced pressure towards their low points. The squeezing pressure of the cuff is directed against the flat surface of the beads and then focused therethrough on the beads' highpoints as they push against the person's body. It is preferable that the plurality of variable compression beads be arranged in alternating rows so that the areas of highest compression on the body are in a zigzag pattern. Once the connective tissue modification cuff is placed around a portion of the body, the upper arm, for example, the cuff can be tightened down via a tensioning system. A preferred tensioning system utilizes a reel and steel lace cable system to evenly tighten the cuff in small increments as needed by the person using it. Once in place, the person then stretches or uses the arm in order to apply the variable compression beads to the connective tissue under use. Such application stretches each portion of the underlying connective tissue to reduce the pain and associated problems.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

Figure 1:
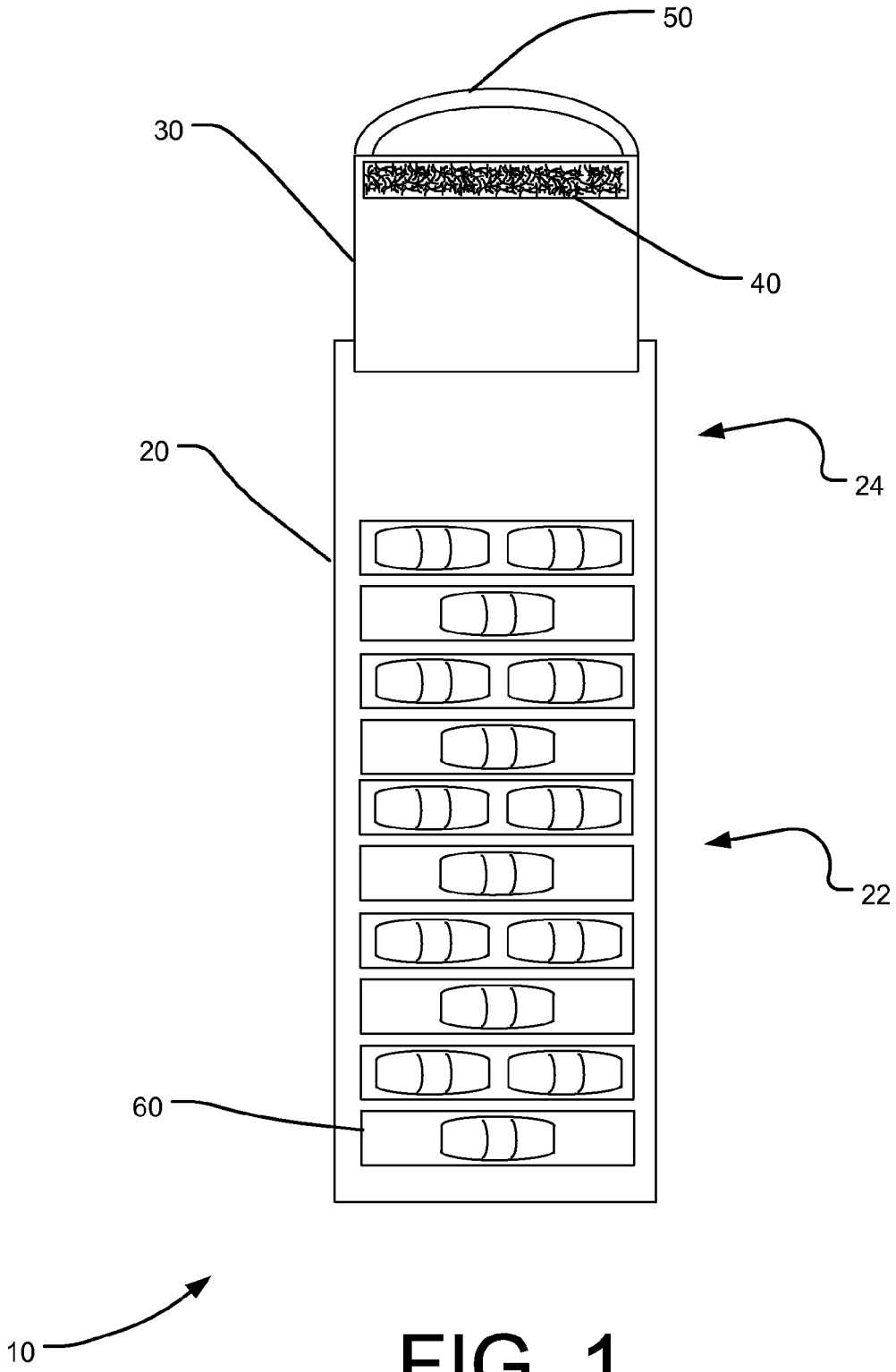
FIG. 1 illustrates a front perspective view of an exemplary embodiment of a connective tissue modification cuff.

Referring now to the drawings, FIG. 1 illustrates a front perspective view of an exemplary embodiment of a connective tissue modification cuff 10. In this view, the interior of the cuff 10 is illustrated (see FIG. 2 for an illustration of the exterior). The main body 20 of the connective tissue modification cuff 10 comprises a variable compression area 22 near the proximal end of the main body 20, and an adjustment zone 24 near the distal end of the main body 20. The variable compression area 22 contains the plurality of variable compression beads 60. In one embodiment, the variable compression beads are arranged in a zigzag alternating pattern as illustrated in FIG. 1. In other embodiments, the variable compression beads can be arranged in various ways. The adjustment zone 24 provides space on the connective tissue modification cuff 10 along which the adjustment tongue 30 can slide as the cuff 10 is tightened. For additional detail concerning tightening the cuff 10, see FIG. 2.

Attached near the distal end of the main body 20 is an adjustment tongue 30. The tongue 30 comprises a low-friction material (such as a stiff plastic, or other similar material) that can slide along the adjustment zone 24 as the tongue 30 is tightened. Although not visible from this view, the adjustment tongue 30 can be adjustably attached to the main body 20 as illustrated in FIG. 2.

At the distal end of the adjustment tongue 30 is a releasable attachment 40. In one embodiment, hook or loop material can comprise the releasable attachment 40. In such an embodiment, a corresponding adjustable attachment area 42 of loop or hook material is utilized to releasably attach the releasable attachment 40 of the adjustment tongue 30 to the exterior of the cuff 20. An exemplary adjustable attachment area 42 is illustrated in FIG. 2; it is located near the proximal end of the cuff 10 on the opposite side of the cuff from the variable compression beads (i.e., on the exterior side of the cuff 10). When the interior surface of the cuff 10 is wrapped around a portion of a person's body (for example, the thigh), the releasable attachment 40 is naturally positioned over the adjustable attachment area 42 and can be locked in place by simply pressing the two together (assuming hook and loop materials are used on the releasable attachment 40 and the adjustable attachment area 42). In other embodiments, other releasable attachment means besides hook and loop materials are contemplated.

In order to assist a person in tightly wrapping the cuff 10 around a portion of his or her body, a tightening handle 50 can be attached to the distal end of the adjustment tongue 30. By first placing the proximal end of the main body 20 of the cuff on the skin and then tightly wrapping the remainder of the cuff around the person's body, the variable compression beads 60 are placed tightly against the person's skin. Then, once the cuff is locked in place, it can be tightened further as desired (see description of tightening process in FIG. 2).

Figure 2:
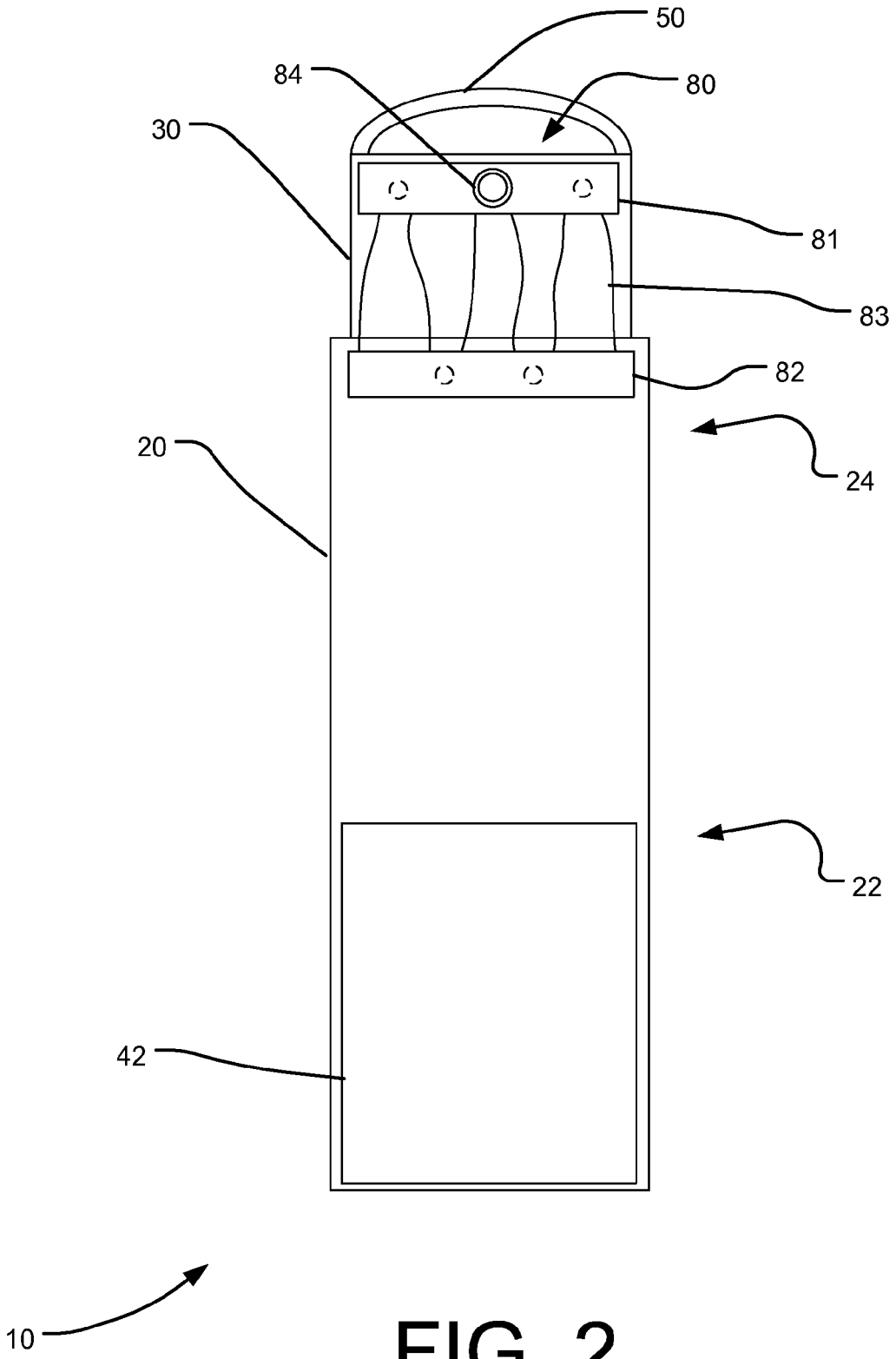
FIG. 2 illustrates a rear perspective view of an exemplary embodiment of a connective tissue modification cuff.

FIG. 2 illustrates a rear perspective view of an exemplary embodiment of a connective tissue modification cuff 10. In this view, the exterior of the cuff 10 is illustrated. The main body 20 of the connective tissue modification cuff 10 comprises a variable compression area 22 near the proximal end of the main body 20, and an adjustment zone 24 near the distal end of the main body. The variable compression area 22 contains the plurality of variable compression beads 60 on the interior side. Since this view illustrates the exterior side, the compression beads 60 are not visible. Instead, the adjustable attachment area 42 of loop or hook material is illustrated. As discussed above, it is utilized to releasably attach the adjustment tongue 30 to the cuff 20. An exemplary adjustable attachment area 42 is illustrated in FIG. 2 located near the proximal end of the cuff 10 on the side of the cuff opposite the variable compression area (i.e., on the exterior side of the cuff 10).

When the interior surface of the cuff 10 is wrapped around a portion of a person's body (for example, the lower arm), the releasable attachment 40 is naturally positioned over the adjustable attachment area 42 and can be locked in place by simply pressing the two together (assuming hook and loop materials are used on the releasable attachment 40 and the adjustable attachment area 42).

An adjustment tongue 30 is attached near the distal end of the main body 20. The tongue 30 comprises a low-friction material (such as a stiff plastic, or other similar material) that can slide under the adjustment zone 24 of the main body 20 as the tongue 30 is tightened. In the embodiment illustrated in FIG. 2, a tensioning system 80 can be employed to selectively tighten the cuff 10 as needed by the user. In the example illustrated in FIG. 2, the tensioning system 80 utilizes a reel and lace cable system. The cable 83 is stretched between two lacing connection areas 81 and 82 that are drawn towards each other by turning the reel 84 and thereby winding the cable up within the reel 84. The reel can unlatch to loosen the cable and allow the user to pull the lacing connection areas 81 and 82 apart from one another.

Figure 3A:
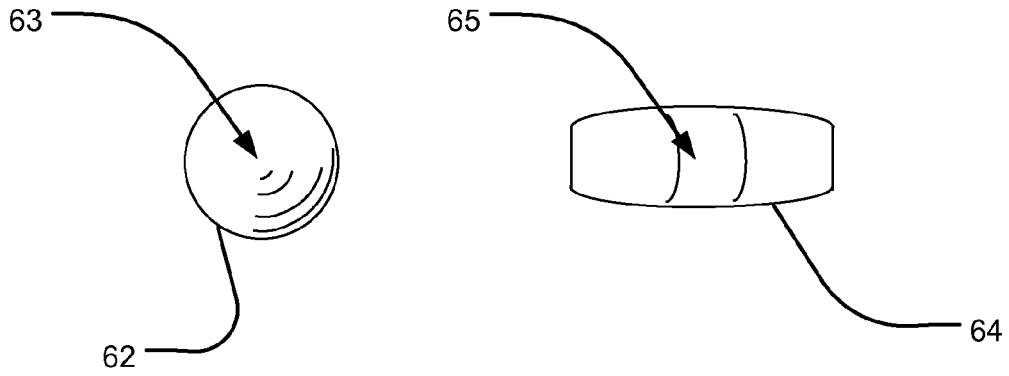
FIG. 3A illustrates a top plan view of exemplary embodiments of variable compression beads that can be used within a connective tissue modification cuff.

FIG. 3A illustrates a top plan view of exemplary embodiments of variable compression beads 62 and 64 that can be used within a connective tissue modification cuff. Exemplary variable compression bead 62 can be shaped like a half-sphere with the top pole of the sphere facing the viewer in the illustration of FIG. 3A. Similarly, an alternate exemplary variable compression bead 64 can be a half prolate spheroid bead with the poles truncated as shown (or left intact, in another embodiment). In either case, variable compression beads 62 and 64 have highpoints 63 and 65 located approximately in the center of their upper surfaces. When the beads 62 and 64 are pressed against the skin of a user, the highpoints 63 and 65 of the beads apply the most compressive pressure, the pressure quickly falling off as you move outwards from the highpoints, thereby comfortably applying varying compression to the underlying connective tissue.

Figure 3B:
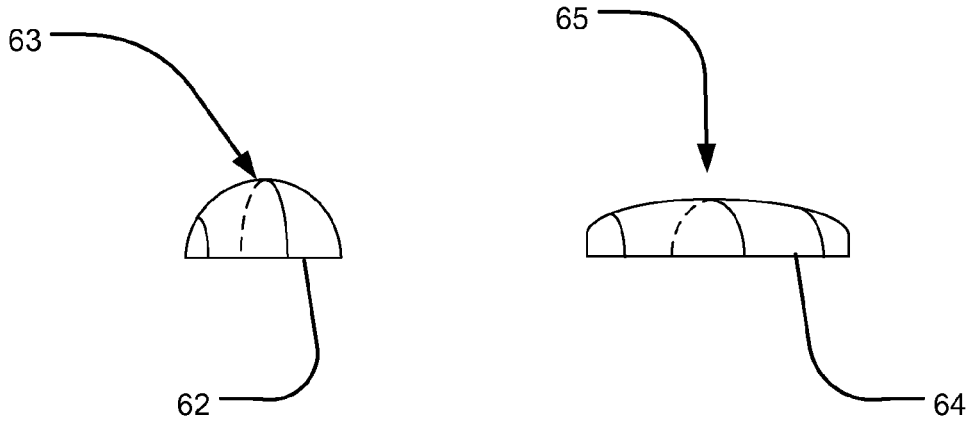
FIG. 3B illustrates a side elevation view of exemplary embodiments of variable compression beads that can be used within a connective tissue modification cuff.

FIG. 3B illustrates a side elevation view of exemplary embodiments of variable compression beads 62 and 64 that can be used within a connective tissue modification cuff. In this view, it is apparent that the highpoint 63 of the half sphere bead 62 has a smaller surface area then the highpoint 65 of the half prolate spheroid bead 64. Other similarly rounded bead shapes without sharp edges and decreasing from a highpoint are contemplated.

The variable compression beads 62 and 64 simulate the application of many massaging fingers pushing into the user's body in a zigzag pattern all at once. Each cuff is designed for maximum compression without the blood flow being disrupted as the beads provide compression "areas" versus the less efficacious and potential dangerous compression "rings" provided by wraps, bandages, etc. Movement is important to the success of the return of freedom of movement and the loss of pain to any nearby area. The user should apply the cuff and then move the surrounding areas of the body to provide best effect.

A plurality of connective tissue modification cuffs 10 can be placed on the upper arm, the forearm, the thigh and the calf of either side of a person's body. The cuffs should be applied firmly, and then tightened to whatever the person using them can handle. The tightness is determined by the individual; however, increasing the tightness so that it approaches an individual's comfortable maximum may increase results. The cuffs can be left in place for two to five minutes. Typically only one side of a person is cuffed at a time to allow a person relatively normal ranges of movement, such is recommended to maximize the value of the cuff.

If a person is experiencing pain in the low back or upper thigh, the cuff should be placed high on the leg, utilizing a larger-diameter thigh cuff. A medium diameter lower leg cuff can be applied around the calf or moved somewhat downwards towards the ankle (but still around the calf).

If arm cuffs are utilized, the cuff should be placed higher on the upper arm if the problem is upper back and neck pain. A medium to small cuff should be placed lower on the upper arm if there is an elbow problem. A small forearm cuff can be placed closer to the elbow if there is an elbow problem. If there is a wrist or hand problem the forearm cuff can be lowered towards the hand. Cuff placement becomes individualized as the person determines which way is best for him/her. In other embodiments, other types of connective tissue modification cuffs 10 are contemplated, such as a migraine cuff.

Figure 4:
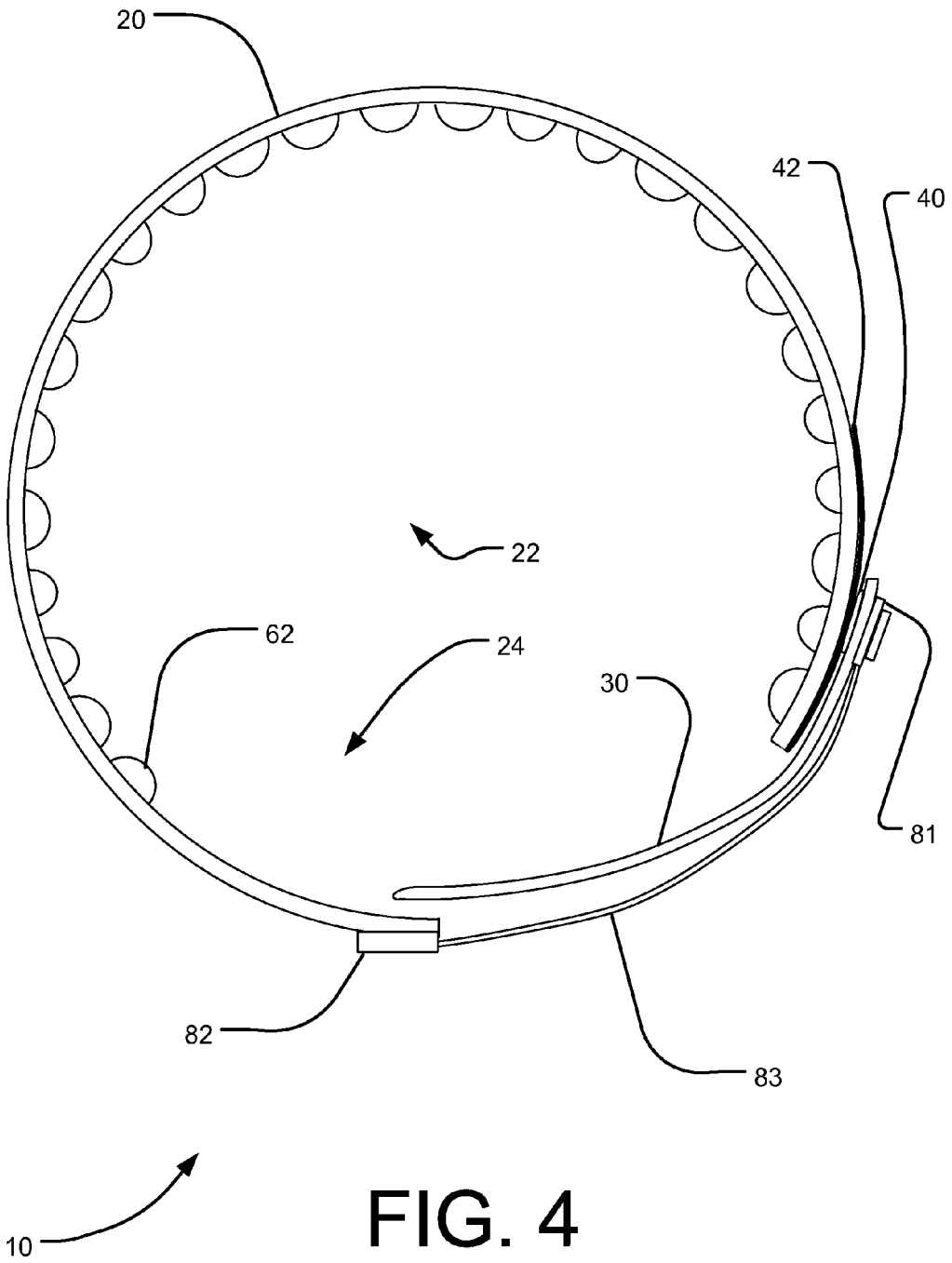
FIG. 4 illustrates a side elevation view of an exemplary embodiment of a connective tissue modification cuff in its wrapping configuration as it would appear when applied about a portion of a person's body.

FIG. 4 illustrates a side elevation view of an exemplary embodiment of a connective tissue modification cuff 10 in its wrapped configuration as it would appear when applied about a portion of a person's body. The components illustrated in the prior FIGs. are shown in this alternate view as well. Note how the adjustment tongue 30 is sliding under the main body 20 of the cuff utilizing the adjustment zone 24. As the tensioning system 80 is used to draw together the lacing connection areas 81 and 82, the 10 is tightened and the adjustment tongue 30 slides ever further under the main body 20.

By clamping down with the cuff as designed, an individual will be able to mimic his/her actions of their daily life that cause the original pain while wearing the cuff(s). These actions may include exercise, work or other stress inducing actions that may put a person into pain. By stretching the connective tissue of large swaths of the long bone areas of the body, a person is able to change enough tissue to relax whole areas of the body. When the cuff is placed on areas where the person has over-exerted and/or distorted the tissue, the cuff brings balance back to the stressed body area. Examples of such issues can include repetitive motion injuries that affect the hands and wrists, such as those who work in factories, line work, knitting, or any other activity which incorporates highly repetitive actions.

Another example of an appropriate user would be an athlete. A person who pitches/throws a ball several times may overuse or over-exert the muscles of the arm. Placing one or more cuffs on the arm and continuing to pitch with smooth motions, will help the problems with the underlying connective tissue. By slowly stretching with the cuff on, the person creates the new space needed to balance the body. Working at the end of a person's tolerance is the best way to work with the cuff. If a person barely stretches, the cuff will have a marginal impact. If instead, the stretch is hard and slow, as the cuff was designed for, the results can be increased.

For low back/hip issues, knees, plantar fasciitis, the lightness associated with being pain free comes with the use of the cuff as described above. By stretching the tissues of the thigh/calf, gains in freedom of movement can be achieved. With that same freedom of movement (from the use of the cuff) comes freedom from pain. Looseness and balance is the key to reducing pain that is associated with most structural pain in the body. If the cuffs are used in tandem, i.e. multiple cuffs used at once, the affects are multiplied in all areas.

The cuff 10 anchors underlying tissue in place, allowing the individual to stretch it at that spot, as well as large swaths of connective tissue of the long-bone areas, allowing the individual to stretch and change large amounts of tissue—enough to relax the entire area of the body and eliminate the residual pain. Cuffs are designed to be used for approximately two to five minutes (other time periods are contemplated). After each use, the wearer should remove the cuff and move the body (e.g., a vigorous walk for several minutes). The cuffs can subsequently be re-applied to the same areas again, as needed.

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above "Detailed Description" section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A connective tissue modification cuff, comprising:

a main body having an exterior surface and an interior surface, and further having a variable compression area near a proximal end and an adjustment zone near a distal end;

the variable compression area containing a plurality of variable compression beads disposed on the interior surface;

the adjustment zone adapted to provide space along the interior surface of the connective tissue modification cuff along which an adjustment tongue can slide as the cuff is tightened;

the adjustment tongue is separate and adjustably attached to the distal end of the main body and adapted to slide against the adjustment zone as the tongue is tightened, wherein a proximal end of the adjustment tongue is a free end and a distal end of the adjustment tongue is adapted to be releasably attached to the distal end of the main body;

a releasable attachment located at the adjustment tongue distal end, the releasable attachment adapted to releasably grasp and hold to a corresponding adjustable attachment area on an exterior surface of the cuff;

a tightening handle attached to the adjustment tongue distal end and adapted to allow a person to grasp and pull the tightening handle to assist the person in applying the cuff tightly around a body portion; and a tensioning system attached to the adjustment tongue distal end and the distal end of the main body of the cuff and adapted to selectively draw the tongue to the main body and thereby decrease an inside diameter of the cuff.

2. The connective tissue modification cuff of claim 1, wherein the plurality of variable compression beads each comprise a half sphere and each is attached to the variable compression area by a flat portion of the half sphere.

3. The connective tissue modification cuff of claim 2, wherein the plurality of variable compression beads is arranged in columns extending longitudinally across the variable compression area.

4. The connective tissue modification cuff of claim 3, wherein every other column is shifted downwards such that the plurality of variable compression beads forms a zigzag pattern.

5. The connective tissue modification cuff of claim 1, wherein the plurality of variable compression beads each comprise a half prolate spheroid and each is attached to the variable compression area by a flat portion of the half prolate spheroid.

6. The connective tissue modification cuff of claim 5, wherein the plurality of variable compression beads is arranged in columns extending longitudinally across the variable compression area.

7. The connective tissue modification cuff of claim 6, wherein every other column is shifted downwards such that the plurality of variable compression beads forms a zigzag pattern.

8. The connective tissue modification cuff of claim 1, wherein the plurality of variable compression beads is arranged in columns extending longitudinally across the variable compression area.

9. The connective tissue modification cuff of claim 8, wherein every other column is shifted downwards such that the plurality of variable compression beads forms a zigzag pattern.

10. A connective tissue modification cuff, comprising:

a main body having an exterior surface and an interior surface, and further having a variable compression area near a proximal end and an adjustment zone near a distal end;

the variable compression area containing a plurality of variable compression beads disposed on the interior surface;

the adjustment zone adapted to provide space along the interior surface of the connective tissue modification cuff along which an adjustment tongue can slide as the cuff is tightened;

the adjustment tongue separate and adjustably attached to the distal end of the main body and adapted to slide against the adjustment zone as the tongue is tightened, wherein a proximal end of the adjustment tongue is a free end and a distal end of the adjustment tongue is adapted to be releasably attached to the distal end of the main body;

a releasable attachment located at the adjustment tongue distal end, the releasable attachment adapted to releasably grasp and hold to a corresponding adjustable attachment area on an exterior surface of the cuff;

a tightening handle attached to the adjustment tongue distal end and adapted to allow a person to grasp and pull the tightening handle to assist the person in applying the cuff tightly around a body portion;

a tensioning system attached to the adjustment tongue distal end and the distal end of the main body of the cuff and adapted to selectively draw the tongue to the main body and thereby decrease an inside diameter of the cuff; and wherein the tensioning system utilizes a reel and laces apparatus adapted to lace together the adjustment tongue and the main body of the cuff, and further adapted to evenly draw together the adjustment tongue and the main body of the cuff as a user turns the reel and thereby winds up the laces.

11. The connective tissue modification cuff of claim 10, wherein the plurality of variable compression beads each comprise a half sphere and each is attached to the variable compression area by a flat portion of the half sphere.

12. The connective tissue modification cuff of claim 11, wherein the plurality of variable compression beads is arranged in columns extending longitudinally across the variable compression area.

13. The connective tissue modification cuff of claim 12, wherein every other column is shifted downwards such that the plurality of variable compression beads forms a zigzag pattern.

14. The connective tissue modification cuff of claim 10, wherein the plurality of variable compression beads each comprise a half prolate spheroid and each is attached to the variable compression area by a flat portion of the half prolate spheroid.

15. The connective tissue modification cuff of claim 14, wherein the plurality of variable compression beads is arranged in columns extending longitudinally across the variable compression area.

16. The connective tissue modification cuff of claim 15, wherein every other column is shifted downwards such that the plurality of variable compression beads forms a zigzag pattern.

17. The connective tissue modification cuff of claim 10, wherein the plurality of variable compression beads is arranged in columns extending longitudinally across the variable compression area.

18. The connective tissue modification cuff of claim 17, wherein every other column is shifted downwards such that the plurality of variable compression beads forms a zigzag pattern.

* * * * *